US005462466A

United States Patent [19]

Hull et al.

[11] Patent Number: 5,462,466

[45] Date of Patent: Oct. 31, 1995

[54] OCCUPANT ACTUATED WATER VEHICLE

[76] Inventors: Harold L. Hull, 401 Canyon Way #43, Sparks, Nev. 89434; Michael J. Choat, 220 Caliente St., Reno, Nev. 89509

[21] Appl. No.: 367,019

[22] Filed: Dec. 30, 1994

[51] Int. Cl.[6] ..... A63C 15/03

[52] U.S. Cl. ..... 441/76; 440/22

[58] Field of Search ..... 441/65, 74, 76, 441/77, 79; 440/13, 14, 15, 21, 22; 114/61, 123

[56] References Cited

U.S. PATENT DOCUMENTS

| | | | |
|---|---|---|---|
| 3,566,427 | 3/1971 | Davis | 9/310 |
| 3,609,782 | 11/1969 | Mabuchi | 9/310 D |
| 3,758,898 | 9/1973 | Dougherty | 9/310 D |
| 3,877,409 | 4/1975 | Krogseng | 115/25 |
| 3,952,353 | 4/1976 | Word | 9/310 D |
| 4,034,430 | 7/1977 | Joyce | 9/310 D |
| 4,037,280 | 7/1977 | Klepsch | 9/310 D |
| 4,117,562 | 10/1978 | Schaumann | 9/310 D |
| 4,129,912 | 12/1978 | Robinson | 440/76 |
| 4,157,597 | 6/1979 | Trebnick | 9/310 D |
| 4,530,668 | 7/1985 | Braun | 441/76 |
| 4,618,329 | 10/1986 | Colez | 441/76 |
| 4,698,039 | 10/1987 | Watson | 441/77 |
| 4,846,743 | 7/1989 | Ping-Chuan | 441/77 |
| 4,952,184 | 8/1990 | Graziano | 441/77 |
| 4,968,273 | 11/1990 | Momot | 440/22 |

FOREIGN PATENT DOCUMENTS

| | | | |
|---|---|---|---|
| 1332642 | 11/1962 | France | 440/22 |

*Primary Examiner*—Stephen Avila

[57] ABSTRACT

A water vehicle which is actuated by the occupant when alternating their body weight simultaneously upon two buoyant members having simultaneous, alternate, vertical movement means for one end of each member. The movement further actuating a pair of flippers to simultaneously, alternately, actuate between a first and second position, therefore causing forward movement. The Water vehicle further provides steering means which allows the occupant to steer the vehicle by simply twisting their waist. This vehicle is easily assembled, dis-assembled and portable.

14 Claims, 2 Drawing Sheets

OCCUPANT ACTUATED WATER VEHICLE

FIELD OF THE INVENTION

This invention relates to an occupant propelled water apparatus but more particularly to a water vehicle, or the like which enables its rider to travel across the surface of water in a guided, controllable manner.

BACKGROUND OF THE INVENTION

There are numerous variations of apparatuses used for walking on water which are known in the art and used. Such apparatuses include structures and/or floats which support a person on water in a standing position and the float structures are propelled through the water by leg movements of the operator. In such an apparatus, the float structures are normally interconnected to permit relative movement there between. The float structures have means for increasing the resistance to movement of the float in one direction of operator leg movement and decreasing the resistance to movement of the float in the opposite direction of operator leg movement to aid in the overall movement of the float structures. The patents to Sheldon, U.S. Pat. No. 1,692,055; Schaupp, U.S. Pat. No. 2,155,939 and Joyce, U.S. Pat. No. 4,034,430 are examples of the same. Such prior art structures are generally complex and expensive in design. Furthermore, they are relatively unstable and difficult to use.

Many attempts have been made to harness the energy of a standing person by using sit-like movements of the legs or the stepping motion of the legs or even use of ski-poles (in this case water poles) to propel an apparatus across water and while a few may have achieved some success, none have satisfactorily solved the inherent problems of stability, mobility, steerability an sufficient forward progress, etc.

Therefore a need exists for a simple apparatus which is easily transportable to the water site and which is safe, inexpensive, and efficient in use.

OBJECTS AND ADVANTAGES

It is a primary object of the present invention to provide an apparatus which is capable of being buoyant in water and to support the weight of a person.

Another object is to provide an occupant propelled water vehicle.

Still another object is to provide means to steer the water vehicle.

Yet another object is to provide means to steer the water vehicle without using the hands or feet of the occupant.

Another object is to provide means to substantially support the occupant in a standing position.

Still another important object is to provide means to propel the water vehicle which requires a minimum of skill and does not require a skiing motion.

It is another object to provide the means to propel the water vehicle by a simple shifting of body weight in a stepping motion.

A most important object is to provide an inner and outer pair of buoyant members.

Yet another important object is to provide means to removably affix a pair of flippers to the inner pair of buoyant members, therefor allowing the apparatus to be easily transported to and from the destination site.

Another object is to provide means for the occupant to cause simultaneous, alternating, vertical swim motion of the flippers when the occupant alternately shifts their body weight in a stepping motion upon the top surface of the inner pair of buoyant members.

Still another object is to make the flippers out of a flexible substance, such as rubber.

Yet a further object is to provide a water vehicle which is easily manufactured and may be made from a variety of materials, such as closed cell, expanded, polyethylene foam or any other buoyant material, etc.

These objects are achieved in accordance with the present apparatus, however further objects and advantages will become apparent when taken into consideration with the following drawings and specification.

DETAILED DESCRIPTION OF THE DRAWINGS

Referring now in detail to the drawings wherein like characters refer to like elements throughout the various views.

Figure 1:
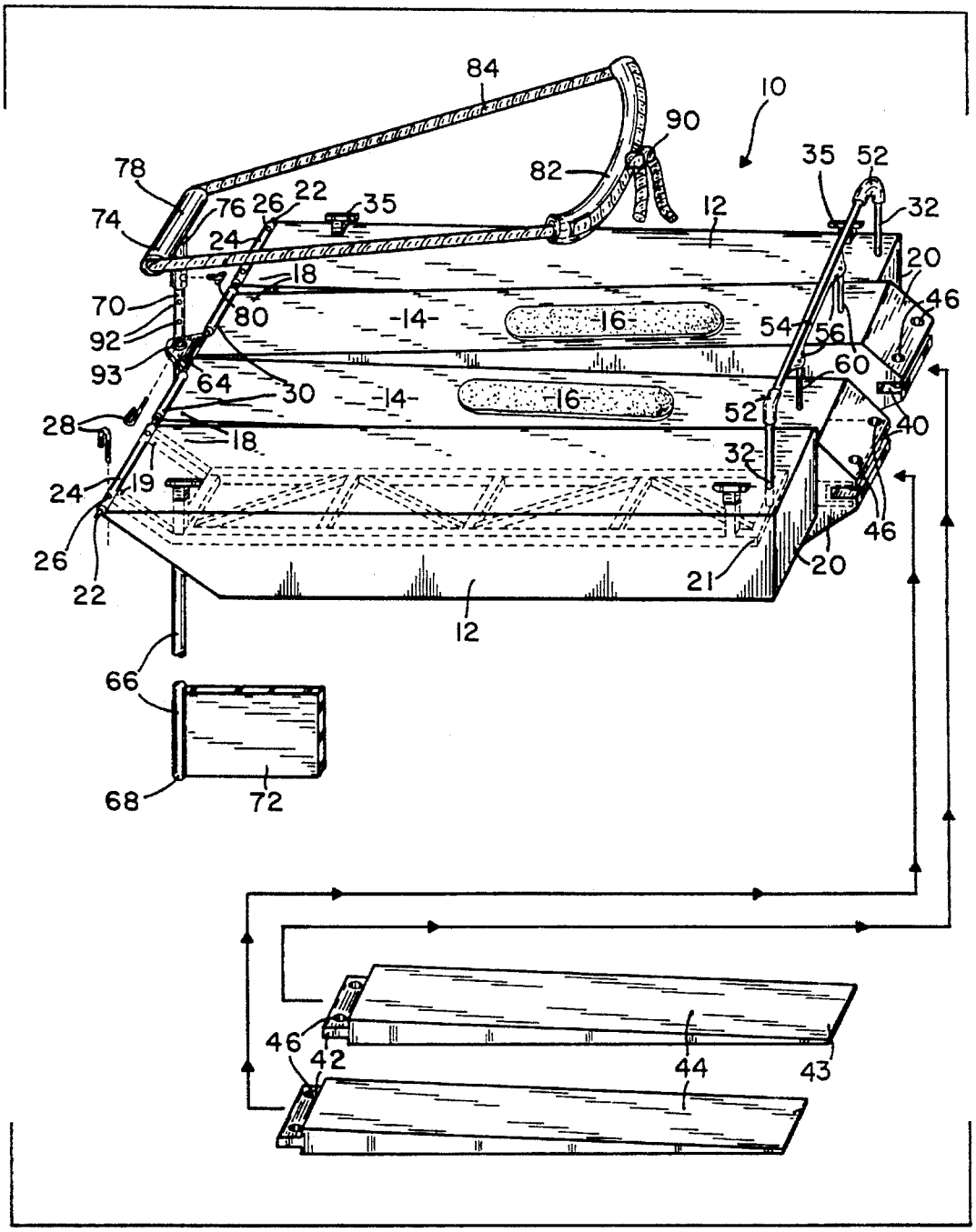
FIG. 1, is a perspective plan view.
Figure 5:
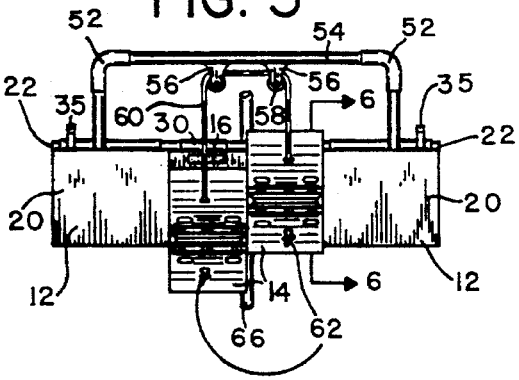
FIG. 5, is a partial, rear view of the apparatus.
Figure 6:
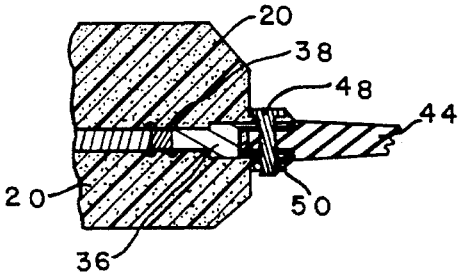
FIG. 6, is an enlarged sectional view taken at 6—6 of FIG. 5.
Figure 7:
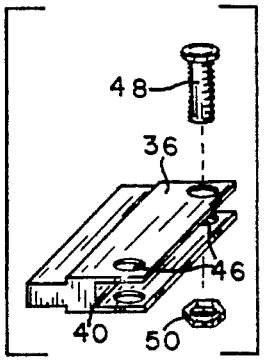
FIG. 7, is an enlarged perspective side view of a bracket.
Figure 8:
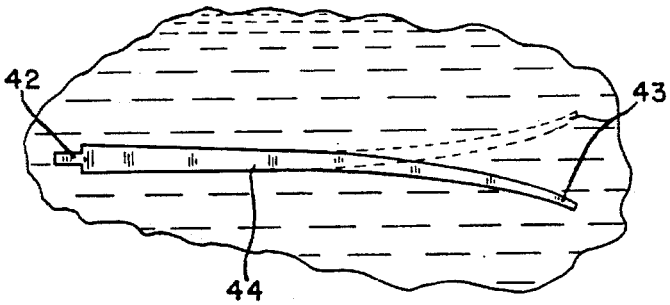
FIG. 8, is a side view of a flipper having a first and second position as illustrated by ghost lines.

Shown in FIG. 1, 10 represents an overview of the present invention while 12 is an outer pair of substantially elongated, buoyant members and 14 is an inner pair of substantially elongated, buoyant members. Each of members 12 and 14 may be made from a variety of buoyant materials, such as Styrofoam, plastic, etc., however, the applicants find that closed-cell, expanded, polyethylene foam, such as manufactured by "FOAMADE INDUSTRIES" of Auburn Hills, Mich., under the tradename "ETHAFOAM" to be most advantageous for this application. It is to be noted that members 12 and 14 may be formed into a variety of shapes as well, however, the present substantially elongated shape proves to be most beneficial. Members 12 and 14 have a top surface for supporting the occupant and at least a portion thereof has a slip-resistant covering 16, thereon. Each of members 12 and 14 are placed and positioned so as to have a side-by-side relationship and each member has a first end 18 and a second end 20. The outer pair of members 12 include internal frame structures 15, represented by ghost lines in FIG. 1. which may be made from a variety of materials such as, plastic pipe, metal pipe, etc., or square metal tubing as herein shown. The frame structures 15 have first and second ends, 19 and 21. The first ends 19 of the frame structures terminating in exterior, horizontal, tubular members 24 which are an integral part thereof (as herein shown) may be fixidly attached thereto by means such as welding (not shown), or the like. The first end 18 of the outer members 12 are removably yet fixidly attached to a horizontal connecting rod 22 by tubular member 24. Member 24 includes at least one vertical bore 26 there through and horizontal connecting rod 22 also includes at least two vertical bores (not shown) there through. Exterior, horizontal, tubular member 24 is of a shape and size to accept horizontal connecting rod 22 when the rod is slidably engaged therein. Vertical bores 26 and the vertical ,bores within rod 22 are of a shape and size to accept a locking pin 28 there through when the bores are aligned. The second ends 21 of the internal structure 15 of the outer members 12, terminating in exterior, uprising members 32 may be an integral part of the internal frame structure 15, if made from square metal tubing, or as herein shown, the uprising member 32 may be a metal pipe which is fixedly attached by welding (not shown) or the like. Further included upon the internal frame structure 15 of the outer members 14 is at least one exterior attachment member 35 for removably attaching an article, such as an anchor, an ice chest, or even a fish stringer, etc. The inner members 14 include internal frame structures 15, the first end 19 thereof terminating in exterior, horizontal, tubular members, such as a pivotal hinge member 30. Hinge 30 may be an integral part of the frame structures 15, or it may be fixidly attached by welding (not shown), or the like. Hinge 30 is of a shape and size to accept connecting rod 22 when inserted there through so as to hingedly attach the first end 19 of frame. structure 15 to the connecting rod 22. The second ends 21 of internal frame structure of the inner members 14 terminating in exterior fittings which are of a shape and size to accept the first end 42 of a flipper 44. The flipper 44 being as described in WEBSTERS DICTIONARY, "a broad, flat limb adapted for swimming", such a fitting is represented by bracket 36, clearly shown in FIG. 7. Bracket 36 may be an integral part of the frame structure 15 or it may be fixidly attached by welding 38, as shown in FIG. 6. Bracket 36 includes a cavity 40 which is of a shape and size to mate and accept the first end 42 of flipper 44, there within. The second ends 20 of the inner members 14, the cavity 40 and the first end 42 of flipper 44, each include vertical bores 46 which when aliened, are of a shape and size to accept a removable attachment means, such as a threaded screw 48 and a nut 50. The second end 20 of each of the outer pair of members 12 being interconnected by a fixidly attached pulley support structure which supports at least one pulley fixidly attached thereto. Such a structure, as herein shown, includes the uprising members 32. Members 32 are removably affixed by threaded pipe elbows 52 to an elongated support pipe 54, whereby, each of the outer pair of members 12 are fixidly, removably, interconnected. Support pipe 54 includes attachment means, such as pulley support brackets 56 which may be fixidly attached to the support pipe 54 by attachment means such as welding, (not shown) or the like. The pulley support brackets 56 provide support for pulleys 58 yet allow the pulleys 58 to rotate freely. The second ends 20 of the inner members 14 have vertical bores there through, (not shown) which are substantially, vertically aligned with pulleys 58 and the bores being of a ,shape and size to accept a cable 60 when inserted there through. Cable 60 having on each of its ends adjustable stop means, such as knots 62, as shown in FIG. 5. Cable 60 being threaded up through one of the vertical bores through the end 20 of one of the inner members 14, through the pulley support brackets 56, down through the opposite vertical bore through the opposite end 20 of the opposite member 14 and is held in an adjustably secure manner by knots 62. Therefore, cable 60 interconnecting each of the second ends 20 of the inner members 14 through pulleys 58, whereby, providing and allowing simultaneous, alternating, vertical movement of the second ends 20 of the inner members 14 when the cable 60 and the pulleys 58 are actuated by the occupant. The occupant (not shown) actuates and causes the vertical movement by alternating, simultaneously, their body weight upon the top surface of the inner members 14.

Figure 2:
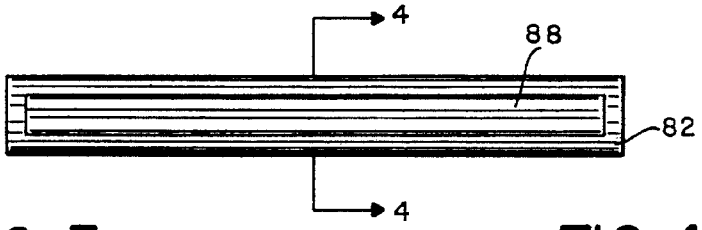
FIG. 2, is an enlarged frontal view of a waist strap.
Figure 3:
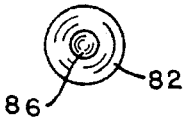
FIG. 3, is an end view of the waist strap of FIG. 2.
Figure 4:
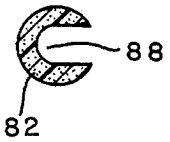
FIG. 4, is a sectional view of the waist strap taken at 4—4 of FIG. 2.

The connecting rod 22 further includes means to attach a steering means substantially at its center section. The means to attach the steering means to the rod 22 includes a support plate 64 which is fixidly attached to the rod 22 by means such as welding, (not shown) or the like. The support plate 64 has a vertical bore there through which has a pivotal relationship with the steering means. The steering means includes a vertical, elongated, cylindrical member 66. Member 66 has a first and second end, 68 and 70. The first end 68 has an integrally formed rudder 72 while the second end 70 includes means to establish multiple, adjustable stops between the steering means and the support plate 64, such as horizontal holes 92, which are of a shape and size to accept a removable pin (such as pin 28) there through. The horizontal holes 92, the pin 28, a washer 93 within the vertical bore of support plate 64, in combination provide for a pivotal relationship and variable, vertical height adjustment for the cylindrical member 66. 74 is a tubular T-shaped member having a vertical leg 76 and a horizontal leg 78, leg 78 having first and second ends. Leg 76 is of a size and shape to accept the second end 70 of cylindrical member 66 when inserted therein. A locking means is provided for removably, attaching the second end 70 of the cylindrical member 66 to the vertical leg 76, such as by a thumb screw 80. The steering means further includes a waist strap 82 having first and second ends and means to adjustably connect the first and second ends of the waist strap 82 to the first and second ends of the horizontal leg 78. The means to adjustably connect (as mentioned above) may be achieved in multiple ways, however, the applicants have found that a rope 84 is most advantageous, the rope may be made from a variety of materials, such as cotton, leather, etc. or as we prefer, nylon. The waist strap 82 may be made from a variety of materials, such as leather, plastic, etc., or as herein shown, it may be made from a buoyant material, such as "ETHAFOAM", previously described. The waist strap 82 may also be formed into various shapes, however, as herein shown in FIG. 2, a substantially, elongated, tubular shape is most beneficial. Furthermore, each of the ends of the waist strap 82 include horizontal bores 86 (shown in FIG. 3) which are of a shape and size to accept the rope 84 when inserted there through. Waist strap 82 further includes a recessed area 88 (shown in FIGS. 3 and 4) which is of a shape and size to adjustably, removably, capture a portion of the rope 84 when inserted therein. It will now be seen that the rope 84 may be threaded from within the recessed area 88, out through one of the horizontal bores 86, through the horizontal leg 78, into the opposite horizontal bore 86, into the recessed area 88, the rope 84 is then secured by an adjustable stop means, such as a knot.

It will now be seen that when the occupant has positioned themselves upon the top surface of members 14 with their feet firmly planted upon the slip-resistant covering 16 and having comfortably adjusted the waist strap 82 and the steering means, the occupant can easily actuate the water vehicle by alternating, simultaneously their body weight upon the top surface of the members 14, whereby, causing simultaneous, alternating vertical movement of the second ends 20 of the members 14 which further causes the flipper 44 to actuate between its first and second position, therefore providing the swim motion and/or the propelling forward momentum for the water vehicle. The occupant actuates the steering means simply by twisting their body at the waist, therefore turning the rudder 72 which causes the water vehicle to turn in a desired direction.

It will now be seen that we have provided a water vehicle which is buoyant, supports a person in a standing position, is occupant actuated, includes steering means which is actuated without the use of the occupants hands and/or feet and is of a unique design which allows for easy assembly, dis-assembly and portability.

Although the invention has been herein shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatuses.

Having described our invention, what we claim as new and wish to secure by letters patent is:

1. An occupant actuated water vehicle comprising: an outer and inner pair of substantially elongated buoyant members, said members having a top surface for supporting said occupant, a first and second end and a side-by-side relationship, said first end of said outer members being removably, fixidly attached to a horizontal connecting rod, a steering means, said rod having means to attach said steering means, said first end of said inner pair of members being removably, hingidly attached to said horizontal rod, said second end of each of said outer pair of members being interconnected by a fixidly attached pulley support structure which supports at least one pulley fixidly attached thereto, said second end of each of said inner members having means to removably attach a flipper, said flipper having first and second ends, a cable interconnecting each of said second ends of said inner members through said pulley, said cable and said pulley working in combination, whereby:

providing and allowing simultaneous, alternating, vertical movement of said second ends of said inner members when said cable and said pulley are actuated by said occupant.

2. The vehicle of claim 1 in which said steering means includes a vertical, elongated, cylindrical member having a first and second end, said first end having an integral rudder, a tubular T-shaped member having a vertical leg and a horizontal leg, said horizontal leg having first and second ends, said vertical leg being of a size and shape to accept said second end of said vertical, cylindrical member, locking means to lock said vertical leg to said second end of said vertical, cylindrical member, a waist strap having first and second ends and means to adjustably connect said first and second ends of said waist strap to said first and second ends of said horizontal leg.

3. The vehicle of claim 2 in which said waist strap is made of a buoyant material.

4. The vehicle of claim 1 in which said means to attach said steering means to said rod includes a support plate attached to said rod, said support plate having a vertical bore, said bore having a pivotal relationship with said steering means and means to establish multiple, adjustable, stops between said steering means and said support plate.

5. The vehicle of claim 2 in which said locking means to lock said vertical leg to said second end of said vertical, cylindrical member, is a thumb screw.

6. The vehicle of claim 2 in which said means to adjustably connect said first and second ends of said waist strap to said first and second ends of said horizontal leg, is a rope having adjustable stop means.

7. The vehicle of claim 6 in which said rope having adjustable stop means, said stop means being a knot in said rope.

8. The vehicle of claim 4 in which said means to establish multiple stops between said steering means and said support plate, includes multiple holes in said steering means, a washer and a removable pin.

9. The vehicle of claim 1 in which said outer pair of buoyant members include internal frame structures having first and second ends, said first ends terminating in exterior, horizontal, tubular members and said second ends terminating in exterior, uprising members.

10. The vehicle of claim 8 in which said internal frame structures include at least one exterior, attachment member for removably attaching an article.

11. The vehicle of claim 1 in which said inner pair of buoyant members include internal frame structures having first and second ends, said first ends terminating in exterior, horizontal, tubular members, said second ends terminating in exterior fittings, said fittings being of a size and shape to except said first end of said flipper.

12. The vehicle of claim 1 in which said flipper is made of rubber.

13. The vehicle of claim 1 in which said buoyant members are made of closed-cell, expanded, polyethylene foam.

14. The vehicle of claim 1 in which said buoyant members having a top surface includes at least a portion thereof having a slip resistant covering.

* * * * *